US007686676B2

(12) United States Patent
Friel, Sr. et al.

(10) Patent No.: US 7,686,676 B2
(45) Date of Patent: Mar. 30, 2010

(54) PRECISION SHARPENER FOR HUNTING AND ASIAN KNIVES

(75) Inventors: Daniel D. Friel, Sr., Greenville, DE (US); Bela Elek, Wilmington, DE (US)

(73) Assignee: Edgecraft Corporation, Avondale, PA (US)

( * ) Notice: Subject to any disclaimer, the term of this patent is extended or adjusted under 35 U.S.C. 154(b) by 32 days.

(21) Appl. No.: 12/103,007

(22) Filed: Apr. 15, 2008

(65) Prior Publication Data

US 2008/0261494 A1 Oct. 23, 2008

Related U.S. Application Data

(60) Provisional application No. 60/912,438, filed on Apr. 18, 2007.

(51) Int. Cl.
*B24B 3/54* (2006.01)

(52) U.S. Cl. ..... 451/45; 451/267; 451/293

(58) Field of Classification Search ..... 451/45, 451/359, 457, 267, 260, 293; 76/82, 88, 76/89

See application file for complete search history.

(56) References Cited

U.S. PATENT DOCUMENTS

| | | | |
|---|---|---|---|
| 4,272,925 | A | 6/1981 | Graves |
| 4,627,194 | A | 12/1986 | Friel |
| 4,716,689 | A | 1/1988 | Friel |
| 4,807,399 | A | 2/1989 | Friel |
| D303,209 | S | 9/1989 | Friel |
| 4,897,965 | A | 2/1990 | Friel |
| D310,620 | S | 9/1990 | Friel |
| 5,005,319 | A | 4/1991 | Friel |
| 5,148,634 | A | 9/1992 | Bigliano |
| 5,245,791 | A | 9/1993 | Bigliano |
| 5,390,431 | A | 2/1995 | Friel |
| 5,582,535 | A | 12/1996 | Friel |
| 5,611,726 | A | 3/1997 | Friel |
| D409,891 | S | 5/1999 | Friel |
| 6,012,971 | A | 1/2000 | Friel |

(Continued)

*Primary Examiner*—Robert Rose

(57) ABSTRACT

A knife sharpener is provided which is capable of precision sharpening of hunting and similar knives that have a first and second blade face, each of which terminates at a facet that meets the corresponding facet to create the knife edge. At least the first of the blade faces has a lower distinct planar or concave section adjacent the edge facet with the lower planar or concave section of the face being set at an angle to the center line of the blade thickness that is different from the angle of the adjoining upper section of the same blade face located adjacent to the back of the blade. The sharpener includes a sharpening member such as one having an abrasive coated surface. The sharpener also includes a planar angle knife guide surface of a knife guide which is designed for intimate sliding and sustaining contact with the second face of the blade in order to position an edge facet on the first of the faces into precise angular relation with the sharpening surface. The sharpener also includes a knife holding spring that applies force against the first face of the blade predominantly at one or more locations on the lower planar or concave section of the first face that is adjacent to the edge facet being sharpened in order that the lower section adjacent the edge on the second face of the blade is pressured to align with and remain in intimate sliding alignment with the guide surface as the blade edge facet on the first face is being sharpened.

25 Claims, 5 Drawing Sheets

U.S. PATENT DOCUMENTS

| | | | | |
|---|---|---|---|---|
| 6,113,476 | A | 9/2000 | Friel | |
| 6,267,652 | B1 | 7/2001 | Friel | |
| 6,726,551 | B2 | 4/2004 | Friel | |
| 6,863,600 | B2 | 3/2005 | Friel | |
| 6,875,093 | B2 | 4/2005 | Friel | |
| 6,881,137 | B2 | 4/2005 | Friel | |
| D513,955 | S | 1/2006 | Friel | |
| D542,616 | S | 5/2007 | Elek | |
| D543,430 | S | 5/2007 | Barr | |
| 7,235,004 | B2 | 6/2007 | Friel | |
| 7,287,445 | B2 | 10/2007 | Friel | |
| D567,611 | S | 4/2008 | Elek | |
| 7,390,243 | B2 | 6/2008 | Friel | |
| 2005/0250428 | A1* | 11/2005 | Friel et al. | 451/349 |
| 2007/0077872 | A1 | 4/2007 | Elek | |
| 2007/0197148 | A1 | 8/2007 | Friel | |

* cited by examiner

PRECISION SHARPENER FOR HUNTING AND ASIAN KNIVES

CROSS-REFERENCE TO RELATED APPLICATION

This application is based upon provisional application Ser. No. 60/912,438 filed Apr. 18, 2007, all of the details of which are incorporated herein by reference thereto.

BACKGROUND OF THE INVENTION

Precision sharpening of hunting style knives and certain Asian knives in knife sharpeners has historically been limited because of imprecise control of the angle of the blade's cutting edge facet as presented to the moving abrasive.

Commonly in sharpeners to control the sharpening angle, the face of the hunting knife is laid on a planar angle guide surface and held there by hand, by a magnet or a spring. Because of the complex geometric design of the face of hunting and certain Asian knife blades the positioning of these style blades on such angle guides is unstable and ambiguous, consequently precise angular control of the facets being ground at the knife edge is seriously compromised.

SUMMARY OF INVENTION

An object of this invention is to provide a sharpener capable of precision sharpening hunting style knives and various Asian knives.

Recently these inventors have discovered a unique spring design that can hold hunting and Asian blades as a class reproducibly and precisely in position against a flat guide plane as they are being pulled through a sharpener by hand. The success of this design requires that force be applied by this spring to the blade at exactly the correct geometric position on the blade face and that these positions work in concert with the forces applied to the knife edge facet as it is being sharpened. The elements that have previously created the instability and the correcting forces will be explained with the help of drawings included here.

THE DRAWINGS

DETAILED DESCRIPTION

Figure 1:
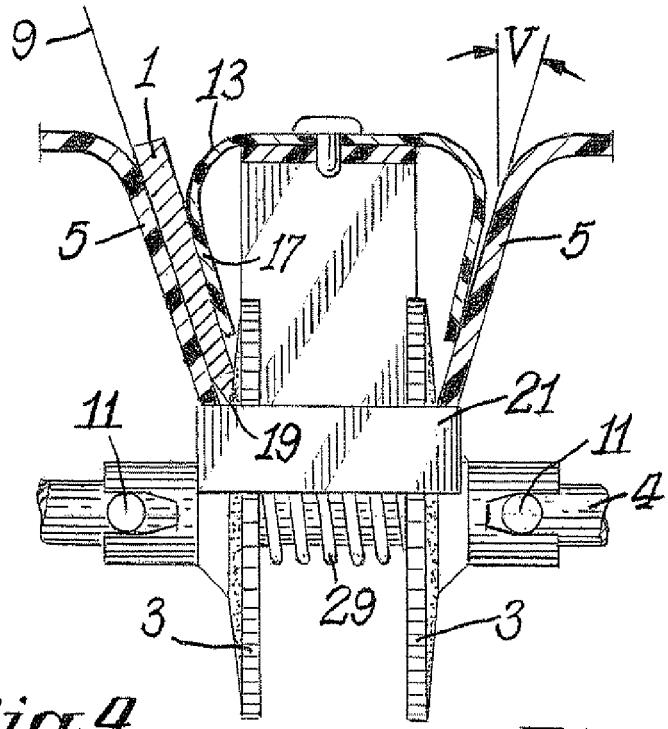
Fig.1.(Prior Art)
FIG. 1 is a side elevational view, partly in section, of a prior art sharpener.

FIG. 1 illustrates the conventional prior art means of controlling the position of a knife blade 1 as its edge facet is placed into contact with a rotating abrasive-covered disk 3. The abrasive disk mounted on shaft 4 is motor driven. The motor is not shown. The conventional knife blade 1 is positioned by hand against the inside surface plane of the knife guide 5 and is pressed against that surface by a conventional inverted U shaped spring 13 that has a large flat arm 17 that presses against the right flat face of a conventional knife 1. This type of knife holding spring conforms well to the flat face of a conventional knife blade and presses the knife's back face into good alignment with the contacting planar surface of the guide 5. Thus a knife whose faces are planar and parallel is securely positioned between arm 17 of the spring 13 and the contacting flat surface of guide 5.

Most kitchen knives, pen knives, slicers, and chefs' knives have flat faces and for these knives a conventional type spring such as spring 13 works well insuring precise angular positioning of the knife edge facet against the rotating abrasive disk 3. A pair of abrasive covered disks is commonly used as shown so that the knife is sharpened first by placing it alternatingly in the left slot and then in the right slot to grind a facet on each side of the edge. Commonly a metal compression spring 29 is placed between the abrasive disks (which are slidable along shaft 4 but restrained by spring 29) to press and position the disks on the shaft 4 against positioning stop pins 11 in the absence of a blade. However, when the blade is inserted fully between spring 13 and the guiding structure 5, the knife edge 19 contacts the rotating abrasive disk and the disk is slidingly displaced along shaft 4 by the edge facet along the rotating shaft against the force of the spring 29. The blade face is manually slid down the guiding surface of guide 5, its edge contacts and then displaces the rotating disk laterally as the knife edge continues to move down until it contacts a stop bar 21. The blade adjacent to its edge then is being pressed securely by spring 29 against the long portion of the guide plane. At the same time the knife holding spring 13 presses the flat faced blade of FIG. 1 against the upper section of the guide surface of guide 5 and the blade is very stable as its edge is being sharpened.

Figure 2:
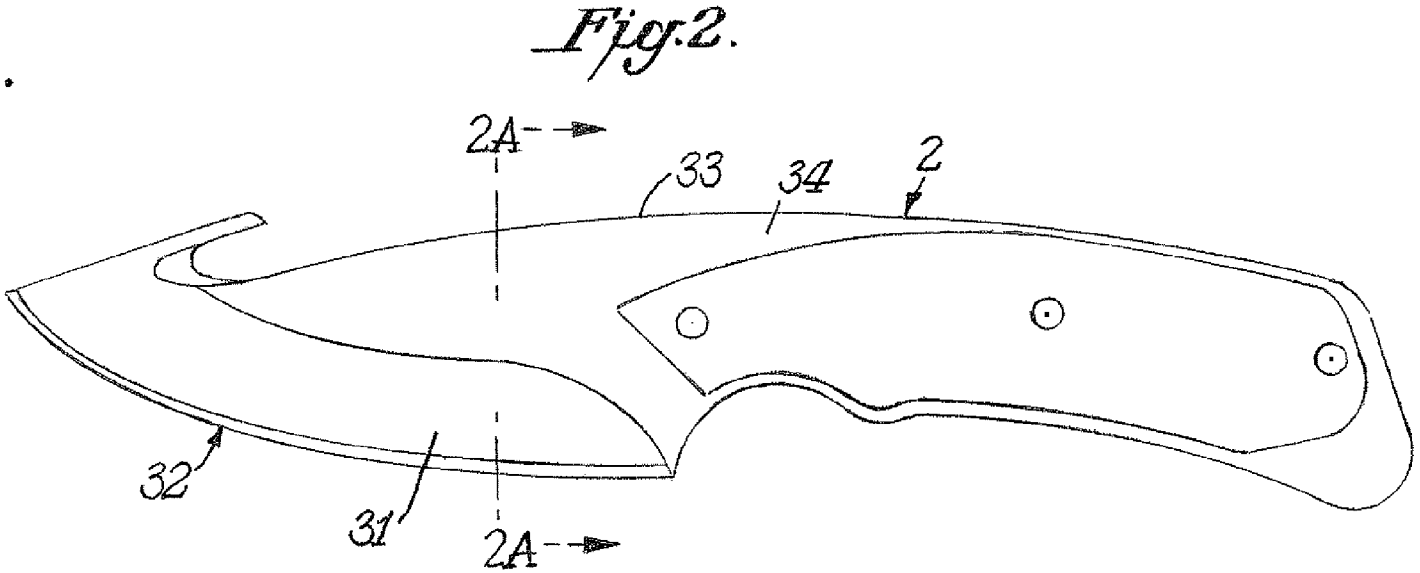
FIGS. 2-3 are side elevational views of typical hunting knives.
Figure 3:
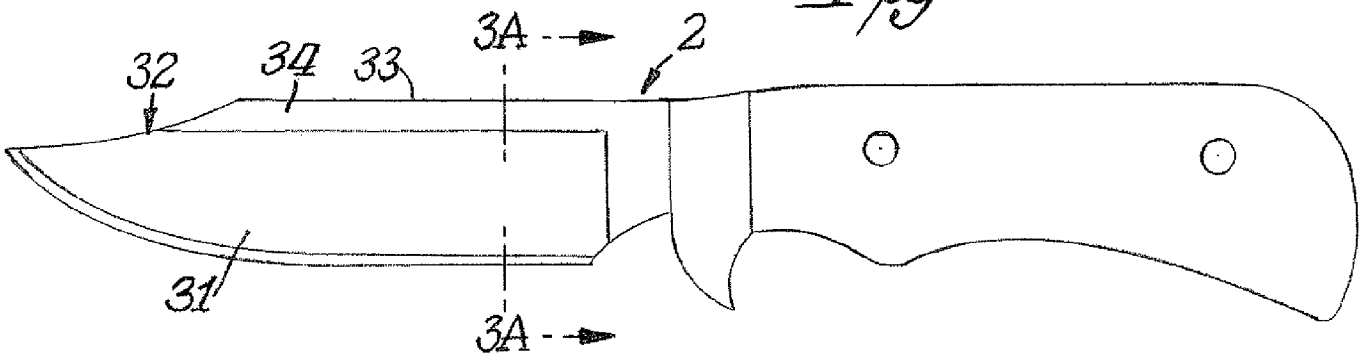

While the conventional shaped knife holding spring 13 works well with the flat faced blade 1 of FIG. 1, the typical hunting knives 2, shown in FIGS. 2 and 3, become surprisingly unstable. Commonly the large portions 31 of the face of hunting knives is hollow ground. The hunting knives are constructed this way to reduce the blade thickness behind the edge so that less metal need be removed to sharpen them and making them easier to sharpen. The back 33 of the blade and the adjacent areas 34 along the blade edge can by this design be very thick, on the order of ⅛ to 3/16" thick, creating a very strong knife for heavy duty work.

Figure 2A:
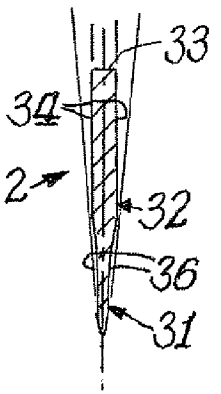
FIGS. 2A and 3A are cross-sectional views of the hunting knives shown in FIGS. 2-3 taken along the lines 2A-2A and 3A-3A, respectively.
Figure 3A:
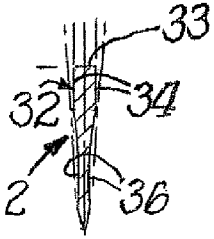

The cross section A-A of these blades is shown in adjacent FIGS. 2A and 3A. These commonly show hollow ground features 36 on the lower sections 31 of the blade face adjacent to the edge but the upper sections 34 of the blade faces adjacent to the blade backs 33 are generally planar and parallel to each other.

Figure 4:
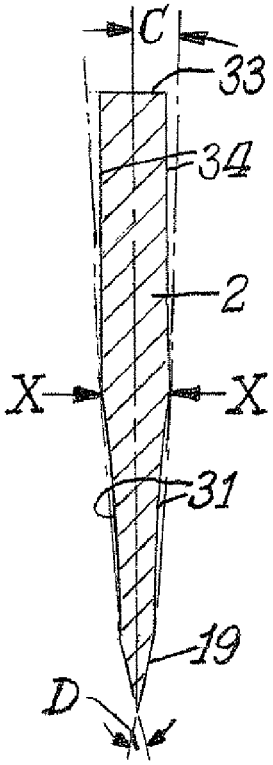
FIG. 4 is a cross-sectional view of a hunting knife.

The cross-section of a typical hunting knife is shown enlarged in FIG. 4. The back 33 (spline) of the blade 2 can be seen to be very thick and the upper section of the faces 34 adjacent the back is flat and parallel. The lower hollow ground sections areas 31 adjacent the edge are concave in shape. While the upper sections of the faces are parallel to the center line of the blade thickness, the lower concave sections lie within a plane that can be considered to be at an angle C relative to that center line. Angle C is commonly 5-6° to the thickness center line on hunting knives.

We have shown that the instability that has existed in alignment of hunting knives while being sharpened stems directly from the fact that the blade being positioned on a knife guide can unknowingly be aligned with either the upper portion 34 of the blade face or on the lower portion 31 (FIG. 4) and that the angle of the planes defined by these two different areas of the blade commonly differ by angle C which is in the order of 5 to 6°. This means that the individual facets being formed can vary this much and the overall (total) edge angle D at the edge can vary by twice this amount or in fact 10 to 12°. It is this inconsistency that these inventors sought to eliminate.

Figure 5:
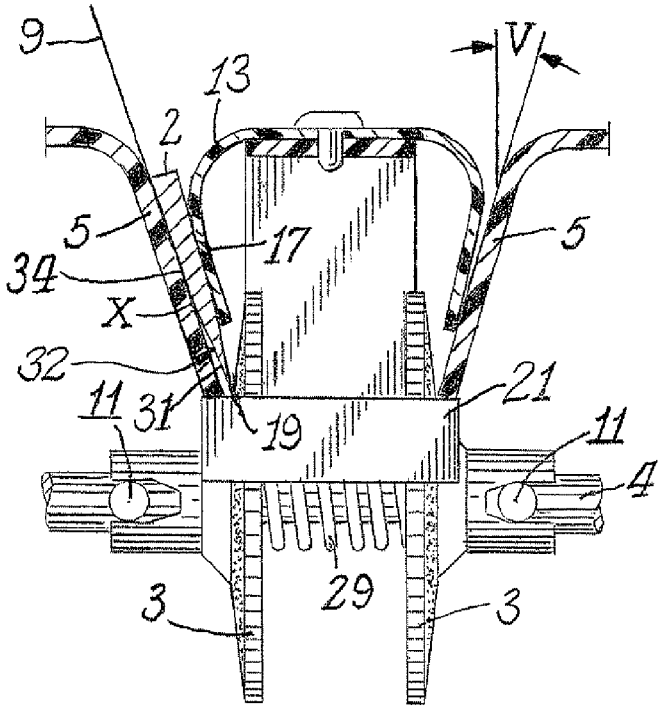
Fig.5.(Prior Art)
FIGS. 5-6 are side elevational views, partly in section, of prior art sharpeners for sharpening hunting knives.
Figure 6:
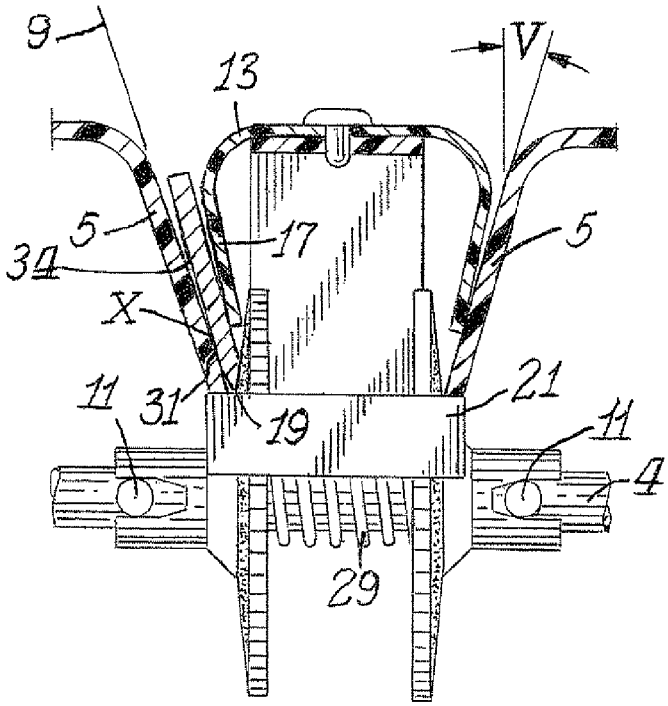
Fig.6(Prior Art)

This instability is illustrated in FIGS. 5 and 6. The FIG. 5 shows the cross section of hunting blade 2 (of FIGS. 2A and 4) aligned with the upper section of the face 34 against the surface of guiding member 5. FIG. 6 shows the same blade 2 with the lower section of its face 31 aligned against the same inner planer surface of guide 5.

Depending upon the exact shape and forces applied to the blade faces in the prior art by the knife positioning spring 13, and the resisting force (sharpening force) applied to the blade edge by spring 29 (FIGS. 5 and 6), the blade will align either with upper section 34 of the face or with the lower section 31 of the face established by the tapered hollow ground area. The blade face sections 34 and 31 (FIG. 5) meet at the point or line identified as X and the instability can act in a see-saw pivoting fashion about line X. See FIGS. 4-7. This action is aggravated when the blade height (width) is non-uniform along the blade length. The higher (wider) portions of the blade face with the arrangement of FIGS. 5 and 6 can experience a larger spring force on the upper section of its face 34 but where the blade height is less that upper force is reduced allowing the force on the lower section of the blade (at the hollow ground area) to dominate and cause the blade to align with the guide as shown in FIG. 6. This complex relationship of the alignment forces has not previously been understood.

These inventors have created a new blade positioning concept using a precision blade positioning spring which eliminates the problem defined above but uniquely also works very well on the conventional kitchen, pen knives, slicing blades, etc.

Figure 7:
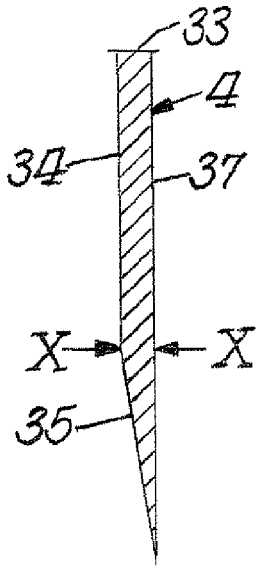
FIG. 7 is an enlarged cross-sectional view of a hunting knife.

A similar problem of controlling the sharpening angle exists in attempting to align specialized Japanese style blades such as the one-sided sashimi blade. The cross section of a blade 4 of this design is shown in FIG. 7. The upper section 34 of this Japanese style blade is similar to the hunting knives in that the blade faces there are parallel to each other but a lower planar section 35 adjacent the edge on one face of the blade is sharply angled at about 10° to the upper parallel face. The opposite face 37 of this specialized blade is entirely planar. As a consequence of its unique design the left face of this type blade as shown in FIG. 7 can become angularly unstable as shown in FIGS. 5 and 6 when one attempts to use a conventional blade holding spring 13 to hold the left upper blade face 34 or the lower left blade 35 in sliding contact with a planar knife guide.

As noted above the described alignment problem exists with both faces of the typical hunting blade but only with one face of the typical sashimi blade. A conventional knife holding spring will hold well only the opposite, and entirely planar face 37 of a sashimi type blade in reliable alignment with the planar surface of the guide 5.

Figure 8:
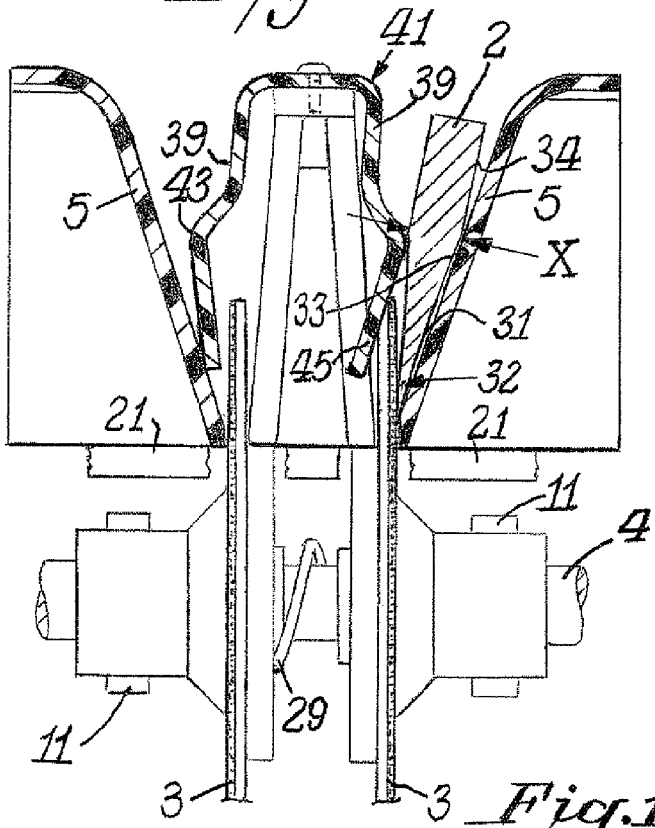
FIG. 8 is a side elevational cross-sectional view of a portion of a sharpener in accordance with this invention.

It was discovered that a substantially different and unique knife holding spring 41 (FIG. 8) can eliminate the problem of angular instability and insure precise alignment of the hunting blades and sashimi blades as they are moved slidingly along a planer knife guide. Pressure by the knife holding spring must be applied to the lower section of that blade face above the edges in order to press the lower section of the opposing blade face into alignment with the angular guide plane. It is preferable that the spring force be applied directly to the concave section 31 (FIGS. 4, 7 and 8) that is adjacent to the blade edge facet. A force applied at that location acts to press that lower planar or concave section of the blade adjacent the edge securely against the surface of the planar knife guide in concert with the sharpening force applied to the facet being sharpened by the spring 29 that presses the abrasive surfaced disk against the edge as it is sharpened. The force being applied by the novel knife holding spring 41 must be located to contact the lowermost portion of the planar area or somewhere on the concave area and optimally relatively close to and preferably below the pivoting line X as shown in FIG. 8. The pressure can be in part slightly above the line X, but not so much above line X and not with sufficient pressure to cause the blade to become unstable and pivot about line X as it overcomes the counter force applied to the edge by spring 29. Spring 41, ideally, should be designed to contact the lower planar or concave section of the knife face at several positions within that section including close to the edge to help the user hold the blade securely and overcome any tendency of the user to disturb the good contact of the lower section of the blade face that is in contact with the angle guiding surface. Contact within the lower section also helps hold conventional planar faced smaller knives in position when one wishes to sharpen such blades, as explained below.

In order to increase the versatility of sharpeners with the novel knife holding spring design as described above, these inventors discovered that by controlling the relative stiffness of the lower and upper portions of the spring arms it is possible to stabilize the larger sporting and Asian blades as described but also to stabilize smaller pocket knives and kitchen paring knives. FIG. 8 shows a spring 41 designed primarily for the hunting and Asian blades where the upper portion 39 of the spring arm is sufficiently flexible that the upper portion will bend sufficiently to allow a thick blade to be inserted between the spring's elbow 43 and the surface of guide 5. This allows the elbow 43 to remain in contact with the blade and to apply the full spring force to the blade at, near or below the line X to insure stability of such larger blades.

Figure 9:
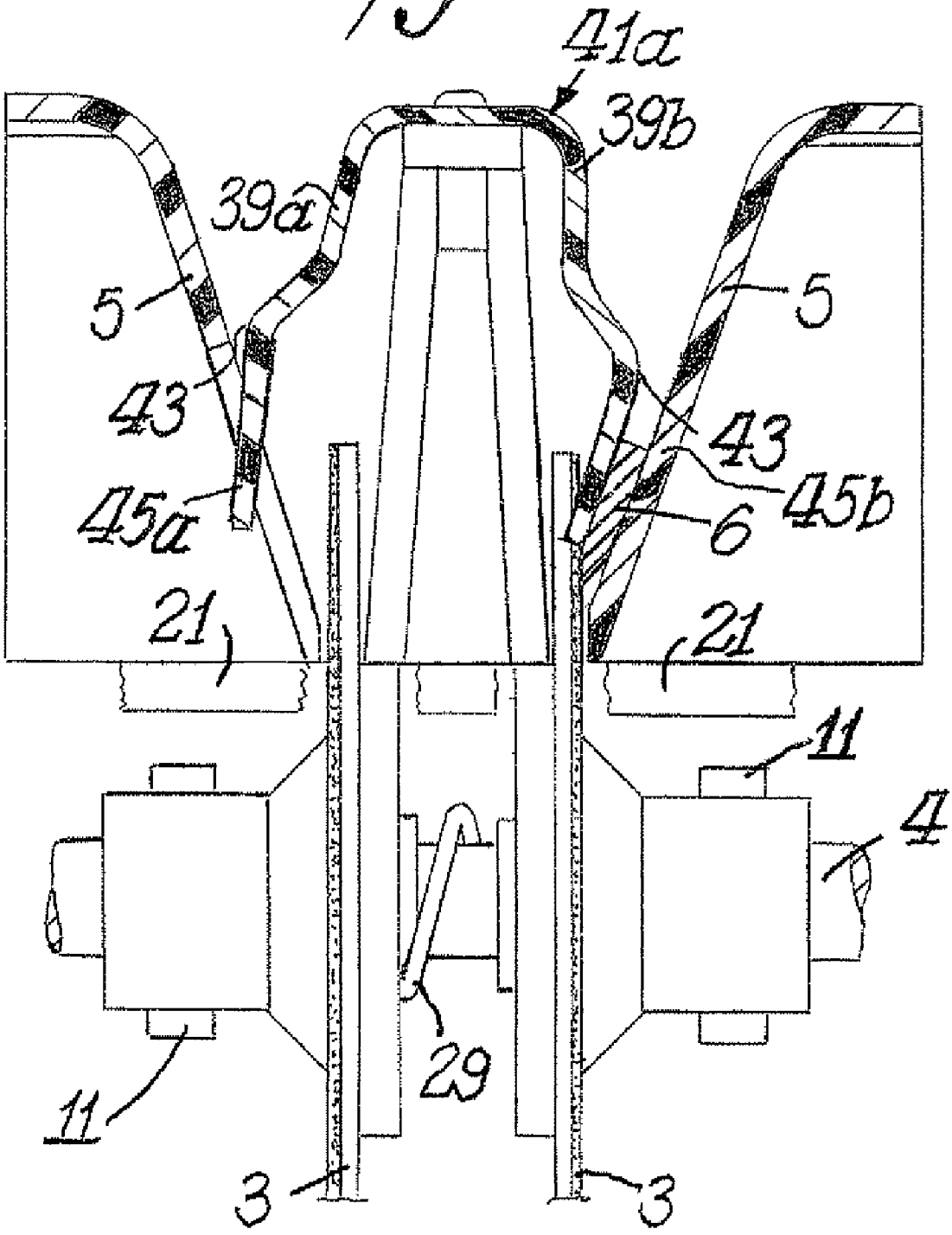
FIG. 9 is a side elevational view of yet another sharpener in accordance with this invention.

We have shown, however, that by molding a spring 41*a* (FIG. 9) with a slightly reduced cross-section 45*a* and 45*b* just below the elbow 43 and by molding that spring portion below the elbow as a more linear extension of the upper portion 39*a* and 39*b* as shown in FIG. 9 that lower portion of the spring (below the elbow) can press against the face of a smaller knife and hold it in place against the surface of guide 5 while such smaller blades are sharpened. By adjusting the relative stiffness of the upper and lower portions of the spring, it is possible to securely hold well such smaller knives while allowing a major fraction of the spring force to be applied at the elbow when a larger blade is inserted.

In practice we find that the spring's elbow is optimally located approximately ⅝ to ¾ inch above the blade edge to hold the larger sporting blades as they are sharpened. A stop bar 21, (FIGS. 8 and 9) is commonly used to control the vertical location of the blade edge as it is being sharpened. The upper portion 39*a* and 39*b* of the spring above the elbow extends in practice approximately a similar distance—about ⅝ to ¾ inch above the elbow and that section is preferably designed to provide clearance as larger knives are inserted and to insure that this portion of the spring above the elbow does not contact the face of the fully inserted blade significantly above line X. The sharpening spring 29 that applies its force to the sharpening disks and in turn to the blade facet acts generally in consort with the knife spring 41*a* in a direction that helps insure that the lower blade section is held in good contact with the surface of guide 5. If the elbow contacts the blade significantly above line X there will be a see-saw type competition of forces between the sharpening spring 29 and the knife holding spring 41*a*. The resultant of the spring forces and their leverages involved must give a net larger leverage force below line X to insure the stabilizing of such large blades. In this situation the balance of forces must act to hold the lower section of the blade in good alignment with the planer knife guide and in no case do you want to create a balance of forces that cause alignment of the upper section of the rear blade face against the knife guide.

The design of a holding spring 41*a* that has proven effective with both smaller blades and a wide range of hunting and specialized one sided Japanese knives is shown in FIG. 9. That figure shows the structure of this novel spring with a cut away of the left knife guide structure in order to illustrate the relaxed unrestrained shape of the spring arms. The right spring arm is shown in its working position when restrained by the knife guide with a small knife blade 6 in place for sharpening. The lower portion 45*b* of the right spring arm presses against the face of the blade as shown. Because the faces of the smaller blade 6 are flat the lower portion 45*b* can press against any area on that blade face and hold the opposite face of the blade in intimate contact with the surface of guide 5.

If a large thick blade is inserted into the right slot it will contact and displace the spring elbow sufficiently toward the left that the lower portion of the spring below the elbow will either move out of contact with the lower section of the thick blade or maintain only lighter contact with that lower section of the blade. The elbow of the spring will press on the blade below, at or only slightly above line x as described earlier.

Figure 10:
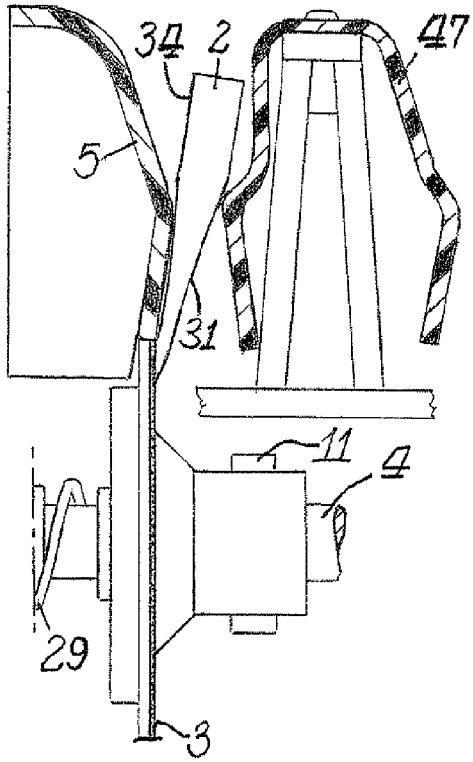
FIG. 10 is another variation of the application of this invention.

As shown in FIGS. 8-10 the knife holding spring 41 and 41*a* is of generally inverted U-shape having an upper bight portion which merges into downwardly extending arms. Each arm has an elbow 43. Each arm then continues downwardly beyond the elbow to a free outer end. The spacing between the elbows is greater than the width of the bight portion. In operation the free outer ends then converge from the respective elbows toward each other when the holding spring is mounted in its position for pressing the knife against the knife guide 5. FIG. 9, however, in the left hand portion shows the free end to diverge outwardly from elbow 43 if the spring is in a condition where the free end does not contact any structure such as the knife blade which is shown in the right hand portion.

Other configurations of this knife guiding concept are possible including the one shown in FIG. 10. The spring design can be very much the same as discussed earlier but it is shown here in another application where the abrasive sharpening element is on that side of the blade opposite the pressing arm of the knife holding spring. The spring is shown on one side of the blade and the abrasive sharpening element is contacting the facet on the opposite side of the blade as shown. This dual arm U shaped spring of FIG. 10 can be supported as shown for example or supported from a cover or other overhead structure (not shown) above the sharpening stages. The spring can be either a dual arm or a single arm design. A dual arm design can be supported in such a manner (FIG. 8) that each of the spring arms serve as a knife guide spring for one of the two sharpening elements in the same sharpening stage or it can be supported between sharpening stages and each of the arms serve as a knife guide spring for a sharpening element in different sharpening stages. The arrangement of FIG. 9 might prove more applicable between sharpening stages and it could be supported either from above or below the top connecting section of the arms. Clearly it is important that the spring arm 47 press against the lower section 31 of the blade 2 so that the blades opposite lower section is pressed into intimate alignment with the surface of the knife guide 5.

Although the prior description has been directed to sharpeners using abrasive coated sharpening members it is to be understood that the invention can also be practiced where the member is a steeling or conditioning member substantially free of abrasive particles. Reference is made to U.S. Pat. Nos. 7,235,004 and 7,287,445, all of the details of which are incorporated herein by reference thereto. Thus, the invention can be incorporated into sharpeners which have sharpening members which use abrasives, which steel the edge or which condition the edge. The knife holding springs will be effective regardless of what is being done to the edge facets. Accordingly, unless otherwise specified the term "knife sharpener" and the term "sharpening member" are intended to include abrasive sharpening as well as steeling or conditioning.

While the need for this improved design has been described as it is used in powered sharpeners that commonly have a force applying spring urging an abrasive covered disk toward the knife edge as it is being sharpened, this novel spring design is applicable also to manual sharpeners with stationary abrading or steeling surfaces. This novel spring in all cases applies a force to the face of the blade as it is manually inserted along the planar surface of a guide and insures alignment with that facial area on the knife closest to the edge regardless whether that area is planer or concave.

What is claimed is:

1. A knife sharpener capable of precision sharpening of hunting and similar knives that have a first and second blade face, each of which terminates at a facet that meets the corresponding facet to create the knife edge where at least the first of the blade faces has a lower distinct planar or concave section adjacent the edge facet, the lower planer or concave section of the face being set at an angle to the center line of the blade thickness that is different from the angle of an adjoining upper section of the same blade face located adjacent to the back of the blade, said sharpener comprising a sharpening member having a sharpening surface, a knife guide having a planar angle knife guide surface designed for intimate sliding and sustaining contact with the second face of the blade in order to position an edge facet on the first of the faces into precise angular relation with said sharpening surface, and a knife holding spring having at least one arm that applies force predominantly against the first face of the blade at one or more locations on the lower planar or concave section of the first face that is adjacent to the edge facet being sharpened in order that only the lower section adjacent the edge on the second face of said blade is dominantly pressured to align with and remain in intimate sliding alignment with said guide surface of knife guide as the blade edge facet on the first face is being sharpened, said knife holding spring arm having an elbow to apply a dominant holding force, a support portion above said elbow, a free end below said elbow, and said free end being a withdrawing shape that can contact the lower blade face.

2. A knife sharpener according to claim 1 wherein said sharpening surface of said sharpening member is an abrasive coated surface.

3. A knife sharpener according to claim 1 wherein said spring is generally in the shape of an inverted U having a bight portion which merges into downwardly extending arms, each of said arms having an elbow portion, the spacing between said elbow portions being greater than the width of said bight, and each of said arms terminating in an outer free end with said outer free ends converging toward each other when said outer free ends are mounted in their knife holding position.

4. A method of precision sharpening of hunting and similar knives that have a first and second blade face, each of which terminate at a facet that meets the corresponding facet to create a knife edge where at least the first of the blade faces has a distinct planar or concave section adjacent the edge facet, and the lower planar or concave section of the face being set at an angle to the center of the blade thickness that is different from the angle of an adjoining upper section of the same blade face located adjacent to the back of the blade comprising the steps of placing the blade in a sharpener against a sharpening member having a sharpening surface and against a knife guiding surface of a planar angle knife guide, and holding the blade against the knife guide by use of a knife holding spring which applies force against the first face of the blade predominantly at one or more locations on the lower planar or concave section of the first face that is adjacent to the edge facet being sharpened in order that the lower section adjacent the edge of the second face of the blade is pressured to align with and remain in intimate sliding alignment with the guide surface of the knife guide as the blade edge facet on the first face is being sharpened.

5. The method of claim 4 including applying insufficient force by the spring against the upper section of the blade to cause the upper section of the second side of the knife to align with the knife guide surface.

6. The method of claim 4 including applying a force by the spring against the upper section of the blade that is less than that which would cause misalignment of the lower section on the second side of the blade with the knife guide surface.

7. The method of claim 4 wherein the spring applies a holding force to one face of the blade that is less than ⅝ inch in height and that has two planar faces each of which terminates at a facet that meets with the adjacent facet to create the knife edge, and the force applied by the spring being of a magnitude adequate to hold the opposing face of the blade in intimate sliding contact with the guide surface of the knife guide.

8. The method of claim 4 wherein the blade is sharpened by abrasive action from an abrasive coated surface of the sharpening member.

9. An electric knife sharpener capable of precision sharpening of hunting and similar knives that have a first and second blade face, each of which terminates at a facet that meets the corresponding facet to create the knife edge where at least the first of the blade faces has a lower distinct planar or concave section adjacent the edge facet, the lower planer or concave section of the face being set at an angle to the center line of the blade thickness that is different from the angle of an adjoining upper section of the same blade face located adjacent to the back of the blade, said sharpener comprising a rotatable sharpening member having a sharpening surface, a knife guide having a planar angle knife guide surface designed for intimate sliding and sustaining contact with the second face of the blade in order to position an edge facet on the first of the faces into precise angular relation with said sharpening surface, a knife holding spring having at least one arm that applies force against the first face of the blade predominantly at one or more locations on the lower planar or concave section of the first face that is adjacent to the edge facet being sharpened in order that the lower section adjacent the edge on the second face of said blade is pressured to align with and remain in intimate sliding alignment with said guide surface of knife guide as the blade edge facet on the first face is being sharpened, said knife holding spring arm having an intermediary located elbow, an upper portion above said elbow, and a free end below said elbow.

10. A sharpener according to claim 9 wherein said rotatable sharpening member is slidably mounted on a shaft, a sharpening member spring urging said sharpening member to slide on said shaft, and said sharpening member spring acting in concert with said knife holding spring to insure that the lower blade section is held in good contact with said guide surface while the blade edge facet is in contact with said sharpening member and the lower section of the blade face is in contact with said spring arm.

11. A sharpener according to claim 9 wherein said free end of said spring arm has a reduced cross-section as compared to the cross-section of said upper portion of said spring arm.

12. A sharpener according to claim 9 wherein said elbow is located a distance of from ⅝ to ¾ inch above the tip of said free end and a distance of from ⅝ to ¾ inch below the upper end of said upper portion.

13. A sharpener according to claim 9 wherein said free end of said spring arm is in contact with said guide surface when no blade is present.

14. A sharpener according to claim 9 wherein said free end of said spring arm is completely spaced from and diverges away from said guide surface when no blade is present.

15. A sharpener according to claim 9 wherein said knife holding spring is an inverted U having two of said arms, and said free ends of said arms diverging away from each other.

16. A sharpener according to claim 9 wherein said knife holding spring is an inverted U having two of said arms, and said free ends of said arms converging toward each other at their tips.

17. A sharpener according to claim 9 wherein said knife sharpener has multiple stages, each of said stages having a power driven rotatable sharpening member, said knife holding spring being an inverted U having two of said arms, said knife holding spring being mounted between two of said stages, and each of said spring arms being located in a respective one of said stages.

18. A sharpener according to claim 1 wherein said free end of said spring arm has a reduced cross-section as compared to the cross-section of said upper portion of said spring arm.

19. A sharpener according to claim 1 wherein said elbow is located a distance of from ⅝ to ¾ inch above the tip of said free end and a distance of from ⅝ to ¾ inch below the upper end of said upper portion.

20. A sharpener according to claim 1 wherein said free end of said spring arm is in contact with said guide surface when no blade is present.

21. A sharpener according to claim 1 wherein said free end of said spring arm is completely spaced from and diverges away from said guide surface when no blade is present.

22. A sharpener according to claim 1 wherein said knife holding spring is an inverted U having two of said arms, and said free ends of said arms diverging away from each other.

23. A sharpener according to claim 1 wherein said knife holding spring is an inverted U having two of said arms, and said free ends of said arms converging toward each other at their tips.

24. A sharpener according to claim 1 wherein said spring arm has only a single bend.

25. A sharpener according to claim 1 wherein said free end of said spring arm is straight from said bend to its tip.

* * * * *